US006112714A

United States Patent [19]

Brister

[11] Patent Number: 6,112,714

[45] Date of Patent: Sep. 5, 2000

[54] SAFETY FUEL TANK AND FILLER CAP APPARATUS

[76] Inventor: Charles Brister, 505 Ellis Rd., Amite, La. 70422

[21] Appl. No.: 09/288,402

[22] Filed: Apr. 8, 1999

Related U.S. Application Data

[63] Continuation-in-part of application No. 09/267,877, Mar. 11, 1999.

[51] Int. Cl.[7] ..... F02B 77/00

[52] U.S. Cl. ..... 123/198 D; 123/198 DC

[58] Field of Search ..... 123/198 D, 198 DC, 123/630, 625

[56] References Cited

U.S. PATENT DOCUMENTS

| | | | |
|---|---|---|---|
| 1,117,741 | 11/1914 | Wood, Jr. . | |
| 3,057,140 | 10/1962 | Ridenour et al. | 56/25.4 |
| 3,568,421 | 3/1971 | Smith et al. | 56/255 |
| 3,750,378 | 8/1973 | Thorud et al. | 56/10.5 |
| 3,885,547 | 5/1975 | Doepke et al. | 123/198 |
| 3,942,604 | 3/1976 | Black, III | 180/103 R |
| 3,969,875 | 7/1976 | Nofel | 56/10.2 |
| 4,236,494 | 12/1980 | Fairchild | 123/630 |
| 5,551,866 | 9/1996 | Josephs et al. | 123/198 D |

*Primary Examiner*—John Kwon
*Attorney, Agent, or Firm*—Garvey, Smith, Nehrbass & Doody, LLC

[57] ABSTRACT

A safety fuel tank and filler cap apparatus is disclosed for use with a powered implement such as a lawnmower, tiller, weed trimmer or the like. The apparatus includes switch members mounted on the fuel cap and tank that disallow engine operation when the filler cap is separated from the tank such as during refueling.

38 Claims, 14 Drawing Sheets

SAFETY FUEL TANK AND FILLER CAP APPARATUS

CROSS-REFERENCE TO RELATED APPLICATIONS

This is a continuation-in-part of U.S. Ser. No. 09/267,877, filed Mar. 11, 1999.

INVENTOR: Charles Brister, a U.S. citizen of 505 Ellis Road, Amite, La. 70422.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to small internal combustion engines of the type that are used to power lawn mowers, tillers, lawn vacuums, weed trimmers, snow blowers, water blasters and the like. Even more particularly, the present invention relates to an improved safety fuel tank and filler cap apparatus that automatically disables the magnetoelectric generator when a fuel filler cap portion of the apparatus is separated from a fuel filler flange such as when the fuel filler cap inadvertently disconnects from the fuel tank or is removed for filling the fuel tank.

2. General Background of the Invention

Every year, fires cause serious and sometimes fatal bodily injury to operators of small yard and garden implements such as lawn mowers, lawn vacuums, weed trimmers and the like. One of the most common problems is associated with the attempt by individuals to add gasoline to a lawn mower or like engine that is still running. Sometimes, an implement gradually loosens the gas filler cap because of vibration. If the user is not paying close attention to the gas tank and its filler cap, gasoline can begin to leak when the cap is loosened. This problem is especially acute with rear drive type implements such as go-karts, riding lawn mowers wherein the gasoline tank may be behind the operator or underneath a seat or hood preventing the user from seeing it. Many tractor style riding lawnmowers have such a hidden fuel tank and filler cap.

Many of these implements are operated by adolescent children that are not warned sufficiently by their parents about the danger of filling tanks with gasoline when the implement or vehicle is hot from operation.

Even adults sometimes have a bad habit of smoking when operating such an implement, so that if the cap loosens, the operator does not notice the escape of fumes if the engine keeps running.

Generators are often filled when running because the user does not want to interrupt the flow of electricity.

All of these situations are hazardous if the engine continues to run when the filler cap is removed.

BRIEF SUMMARY OF THE INVENTION

The present invention provides and improved safety fuel tank and filler cap apparatus for supplying fuel to an internal combustion engine that can be started with a magnetoelectric generator.

The apparatus includes an exposed fuel tank having a fill opening, a fuel filler flange surrounded by an adjoining fuel tank outer surface, the flange extending a short distance from the filler opening in the fuel tank wall.

A filler cap fits the fuel filler flange to form a closure of the tank at the fill opening, the filler tank and adjoining fuel tank outer surface being configured to enable a user to grip and turn the fuel filler cap.

A switch is interfaced between the fuel tank and filler cap that disables the magnetoelectric generator when the filler cap is removed from the fuel filler tank. This construction prevents the user from filling the fuel tank with gasoline when the engine is running.

The switch can be a magnetic switch, a photoelectric switch, or a mechanical switch such as a button switch , toggle switch, rocker switch, as examples.

The mechanical switch can be a switch that moves between operating and disabled positions, the switch including a moving member that shifts positions when the fuel filler cap is separated from the fuel filler flange.

The switch can include a magnetic switch member mounted in the fuel tank and another magnetic switch member mounted on the filler cap.

The switch can include a switch member mounted on the filler cap the does not interfere with the sealing of the fuel filler flange with the filler cap, being spaced from the threads or bayonet connectors that join the cap and tank.

The filler cap can have a top, an annular skirt with internal threads, and wherein the switch member is mounted on the annular skirt in between the threads and the top. Such internal threads form a threaded engaged connection with external threads on the fuel filler flange.

The fuel fuller cap preferably has a top, an annular skirt with a threaded portion thereon, and an unthreaded outer surface and wherein the switch member is mounted on the annular skirt. The switch member can be mounted on an unthreaded portion of the filler cap.

The present invention also teaches and provides a powered implement that has a frame, an internal combustion engine mounted on the frame that includes a magnetoelectric generator for starting the engine, and including an exposed fuel tank having a fill opening, a fuel filler flange surrounded by an adjoining fuel tank outer surface, the flange extending a short distance from the filler opening in the fuel tank wall and wherein a filler cap fits the fuel filler flange to form a closure of the tank at the fuel opening.

The filler cap and adjoining fuel tank outer surface are configured to enable a user to grip and turn the fuel filler cap. A switch is interfaced between the fuel tank and filler cap that disables the magnetoelectric generator when the filler cap is removed from the fuel filler flange, the switch including switch portions mounted respectively on the fuel tank and on the fuel filler cap.

The implement can be for example a lawn mower, go-kart, garden tractor, lawn vacuum, snow blower, tiller, chain saw, weed trimmer, hedge clipper, or log splitter.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
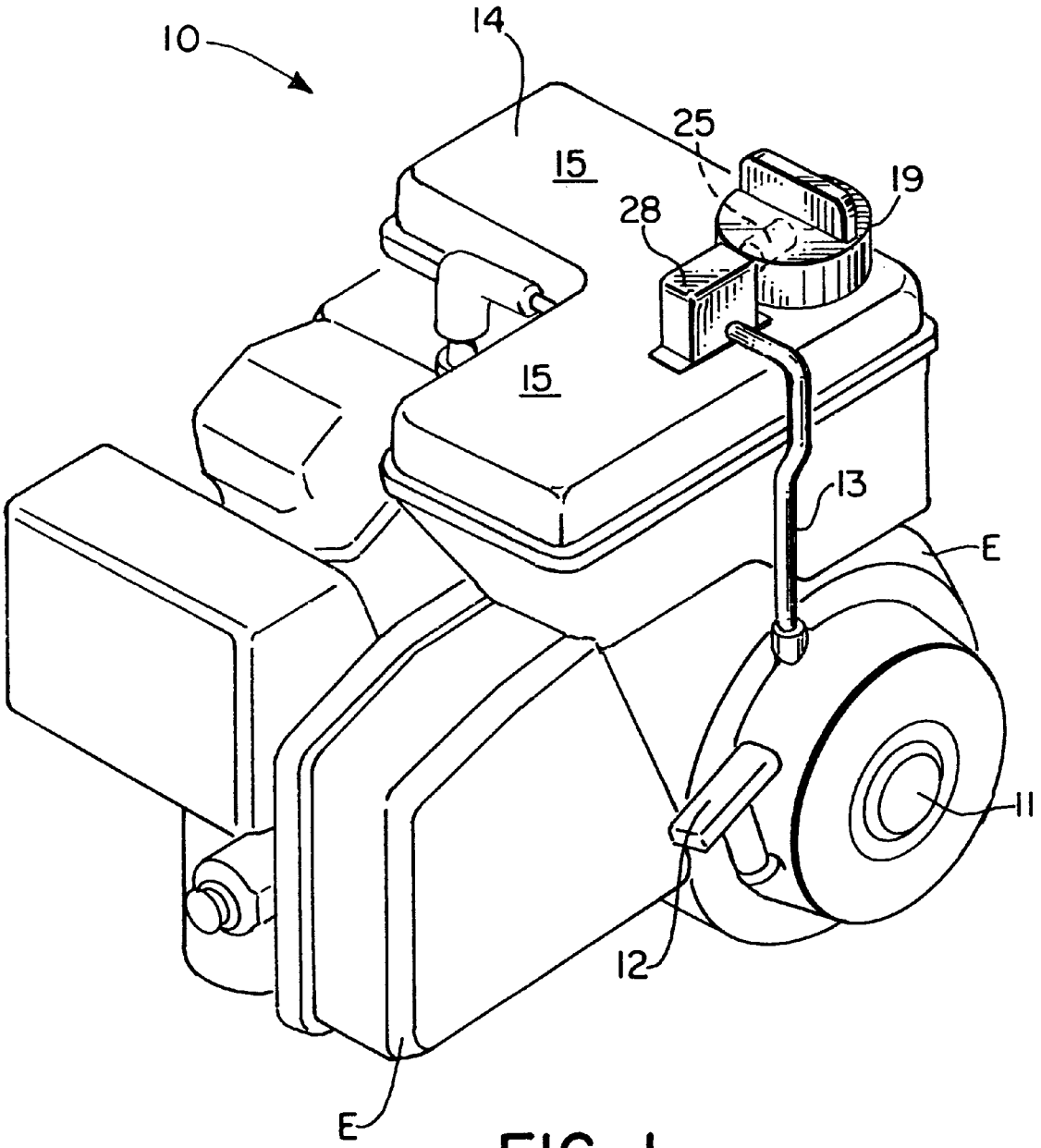
FIG. 1 is a perspective view of the preferred embodiment of the apparatus of the present invention.
Figure 1A:
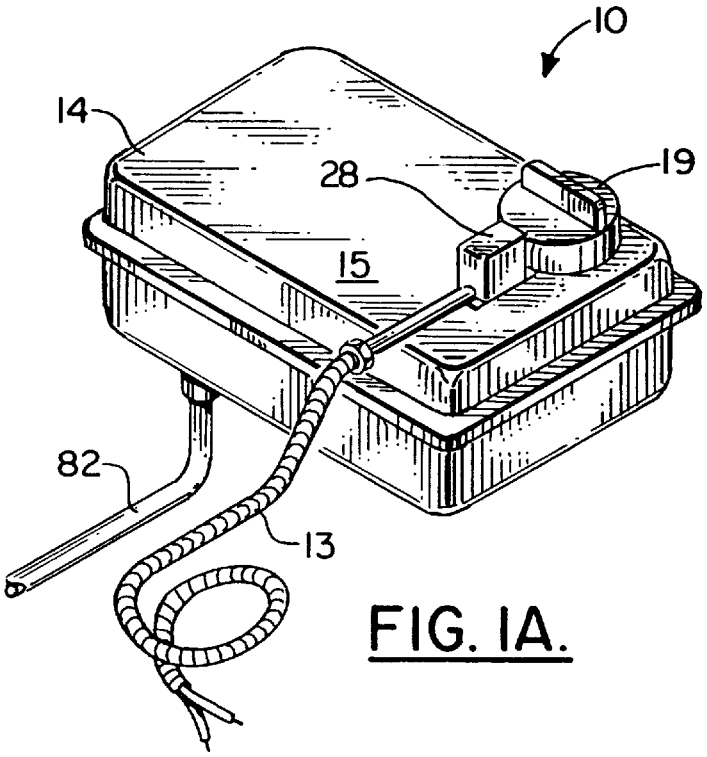
FIG. 1A is perspective view of the preferred embodiment of the apparatus of the present invention used with an auxiliary tank.
Figure 1B:
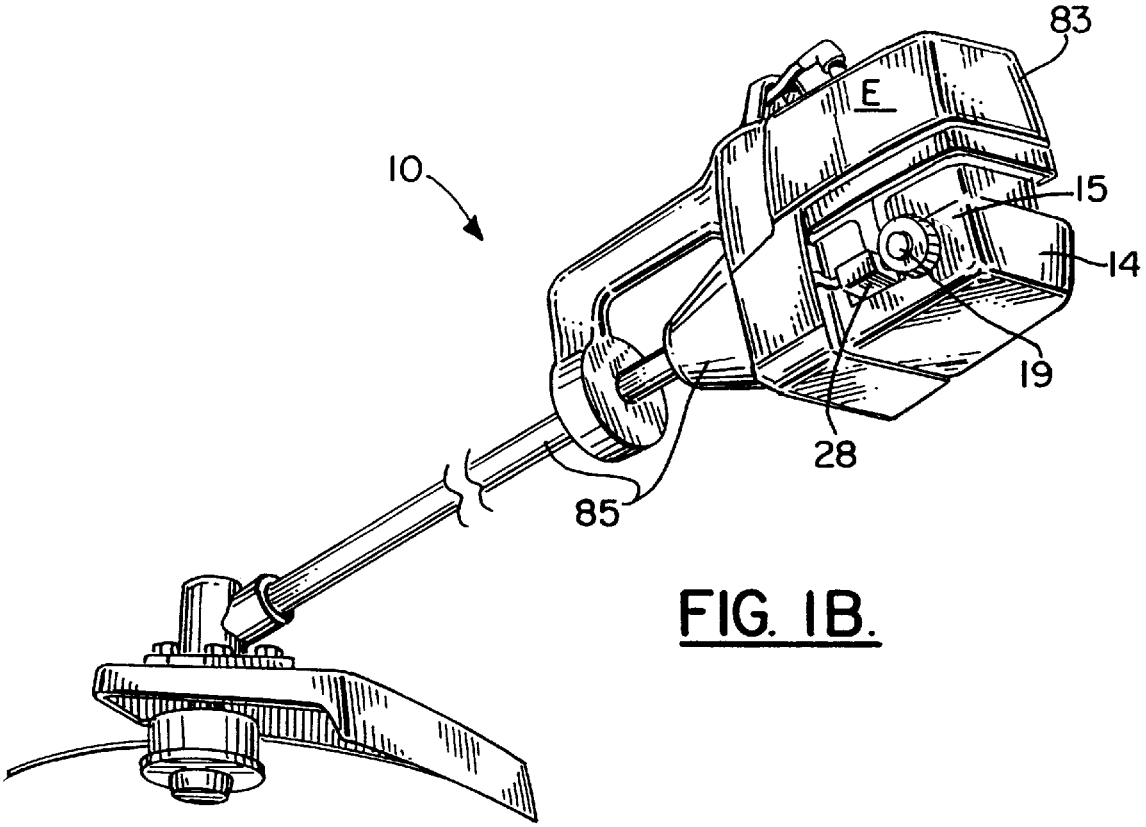
FIG. 1B is a perspective view of the preferred embodiment of the apparatus of the present invention showing a powered implement in the form of a weed trimmer.

FIGS. 1, 1A and 1B show the preferred embodiment of the apparatus of the present invention designated generally by the numeral 10 in FIGS. 1, 1A and 1B.

Safety fuel tank and cap apparatus 10 includes a safety system that disables internal combustion engine E if a user removes the fuel filler cap 19 from cylindrically shaped flange 16 of fuel tank 14. Engine E is a type that includes a magnetoelectric generator 11 that can be operated with an electric starter (not shown) or a pull cord starter rope 12. An electrical circuit is provided for disabling magnetoelectric generator 11 when filler cap 19 is removed from fuel tank 14 as will be described more fully herein. An electrical cable 13 extends between a switch mounted on the upper surface 15 of fuel tank 14 and the magnetoelectric generator or "magneto" 11.

Figure 2:
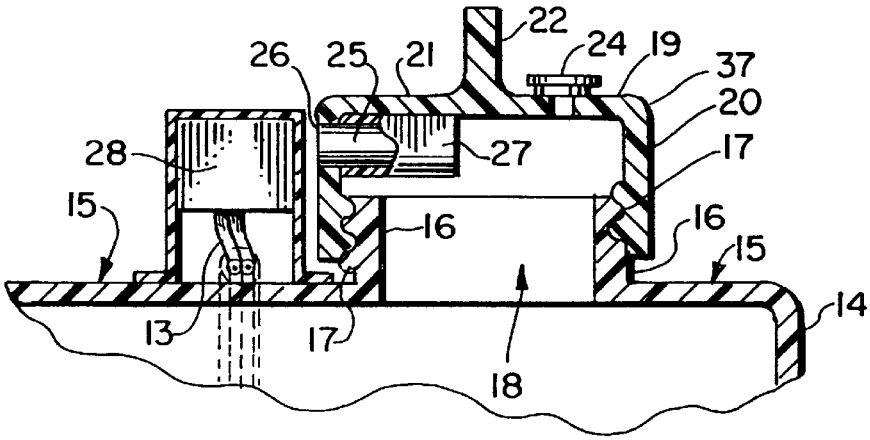
FIG. 2 is a partial sectional elevational view of the preferred embodiment of the apparatus of the present invention.

The fuel filler cap 19 in FIG. 2 provides an internally threaded portion 23 that interlocks with external thread 17 on cylindrically shaped flange 16. The cylindrically shaped flange 16 surrounds fuel tank opening 18.

Filler cap 19 is comprised of a circular top portion 21 and a generally cylindrically shaped annular skirt 20. The top portion 21 is joined to the skirt 20 at annular edge 37. Skirt 20 has an inner annular, generally cylindrically shaped surface 20A and an outer annular generally cylindrically shaped surface 20B. Skirt 20 outer surface 20B can be knurled or ribbed to ease gripping by a user. Inner surface 20B can be threaded (see FIGS. 2, 3A–3B, 5A–5B) or a bayonet mount (see FIGS. 14–15). Handle 22 is positioned on top 21 for enabling a user to remove cap 19 from flange 16 or for engaging cap 19 with flange 16. The cap 19 can include a vent 24 for releasing fumes.

The filler cap 19 can be an internally threaded cap as shown in FIGS. 1–11. Alternatively, the filler cap can be a bayonet type cap 19A, 19B as shown in FIGS. 12A, 12B, 12C, 13A, 13B and 13C. Such a bayonet mount type cap 19A, 19B is used on engines such as Honda® and Briggs® for example.

A magnet 25 is embedded in the unthreaded upper portion of cap 19 next to top 21 as shown in FIG. 2. Magnet 25 provides an outer end 26 that is positioned next to the annular skirt 20. The inner end 27 of magnet 25 is positioned nearer the center of circular top as show in FIG. 2.

A magnetic switch 28 is mounted on upper surface 15 of fuel tank 14 adjacent to cylindrically shaped flange 16. Magnetic switch 19 includes an electrical cable 29 that communicates with electrical cable 13 extending to magneto 11. The electrical cable 13 can include a pair of wire leads 29A, 29B as shown in FIGS. 3A, 3B.

Figures 3A, 3B:
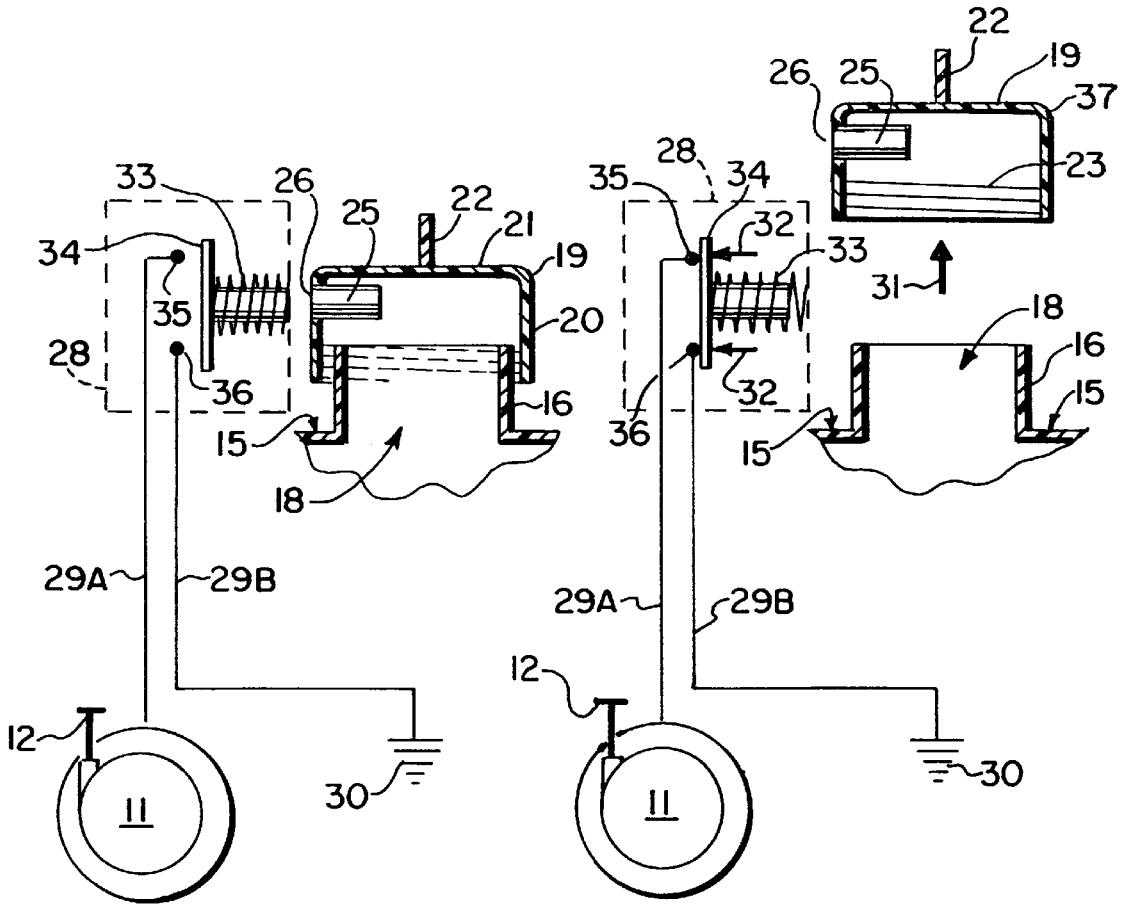
FIGS. 3A–3B are schematic diagrams of the preferred embodiment of the apparatus of the present invention shown in engine operating (FIG. 3A) and engine disabled (FIG. 3B) positions.

In FIG. 3A, the magnet 25 is shown with its outer end 26 positioned next to magnetic switch 28. Spring 33 is overcome by magnet 25 so that it pulls contact plate 34 toward magnet 25 and away from contact points 35, 36. This condition shown in FIG. 3A occurs when the gas filler cap 19 is in a fully closed position. In this closed position, the magnet 25 is generally aligned with the magnetic switch 28 as shown in FIGS. 1, 1A, 1B, 2 and 3A.

In FIG. 3B, a user has separated the gas filler cap 19 from cylindrically shaped flange 18 as indicated schematically by arrow 31. In such a situation, the spring 33 forces contact plate 34 into contact with leads 35, 36. Arrows 32 in FIG. 3B indicate schematically the movement of contact plate 34 into contact with points 35, 36. In such a situation, electrical power generated by the magneto is unable to start the engine E.

Figure 4:
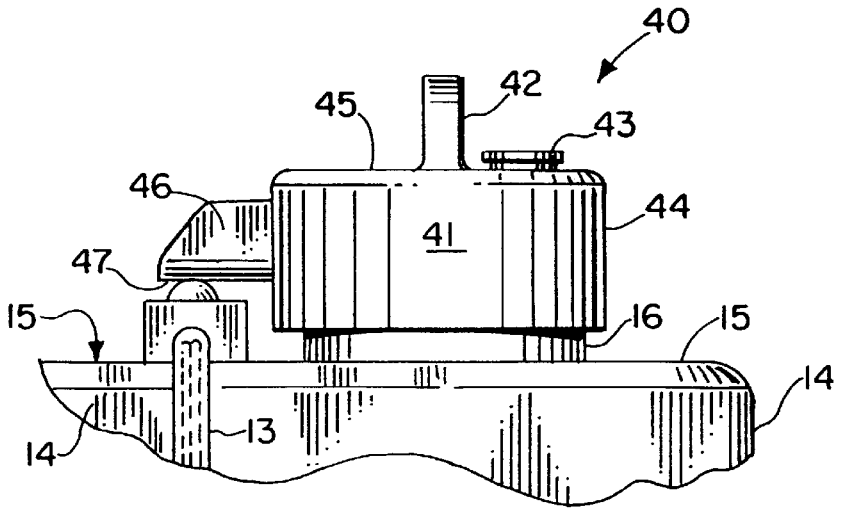
FIG. 4 is a side elevational view of a second embodiment of the apparatus of the present invention.
Figure 5A:
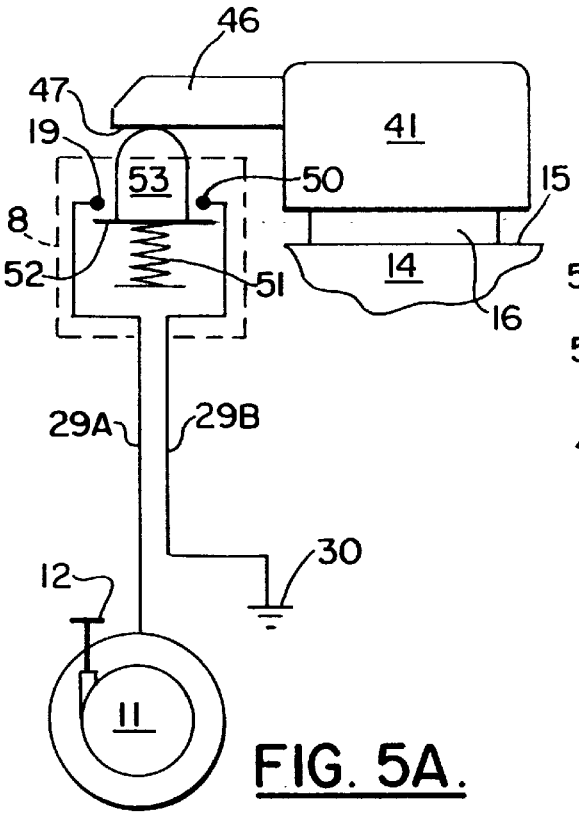
FIGS. 5A–5B are schematic sectional elevational views of the second embodiment of the apparatus of the present invention showing the switch in engine operating (FIG. 5A) and engine disabled (FIG. 5B) positions respectively.
Figure 5B:
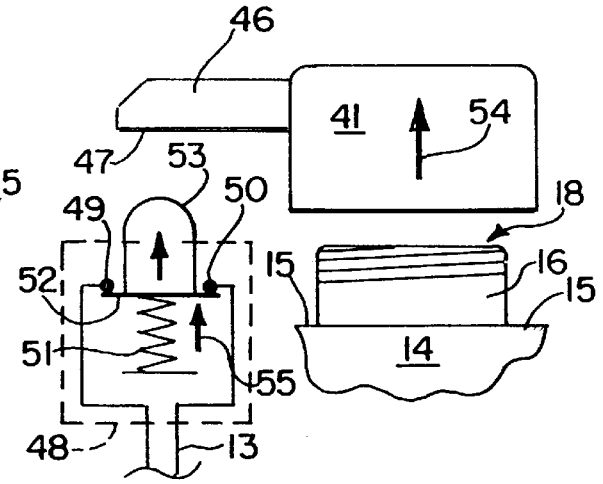

In FIGS. 4, 5A and 5B, there is shown a second embodiment of the apparatus of the present invention designated generally by the numeral 40. Safety fuel tank and cap apparatus 40 includes a cap 41 having a handle 42. Cap 41 can also provide a vent 43. The cap 41 is comprised of a generally cylindrically shaped annular skirt 44 and a circular top 45.

An appendage 46 extends radially outwardly of skirt 41 as shown in FIGS. 4, 5A and 5B. The appendage 46 has an under surface 47 that engages switch button 53 of button switch 48. The button switch 48 is shown in FIG. 5A in an operating position wherein appendage 46 holds the button 53 in a lowermost position that spaces contact plate 52 away from contacts 49, 50. When the cap 41 is removed as shown in FIG. 5B from cylindrically shaped filler flange 16 as shown by arrow 54 in FIG. 5, the spring 51 moves switch button 53 upwardly so that contact plate 52 engages contacts 49, 50 as shown by arrow 55 in FIG. 5B. In such a situation, the magneto 11 will not start the engine E.

Figure 6:
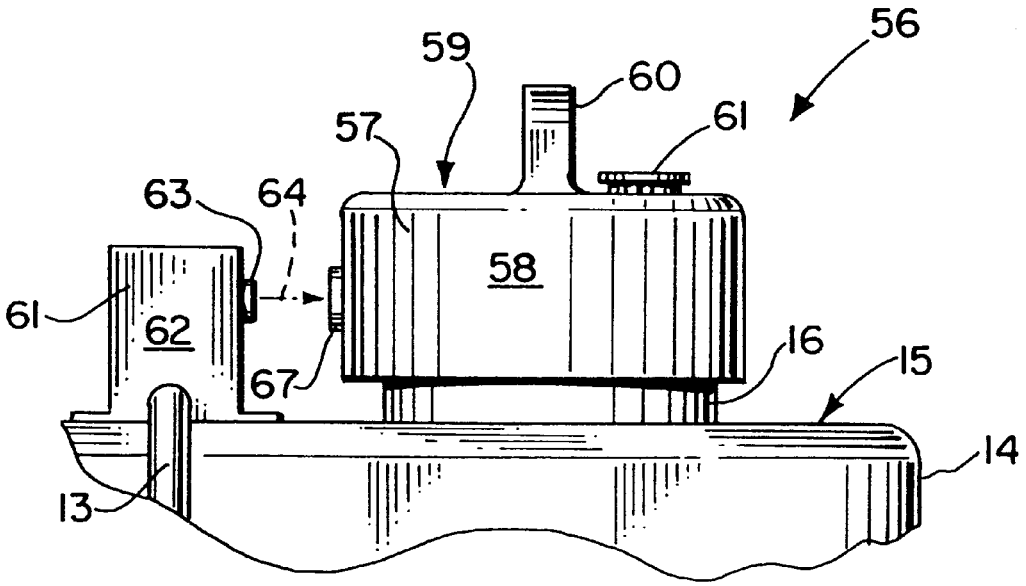
FIG. 6 is an elevational view of a third embodiment of the apparatus of the present invention.
Figure 7:
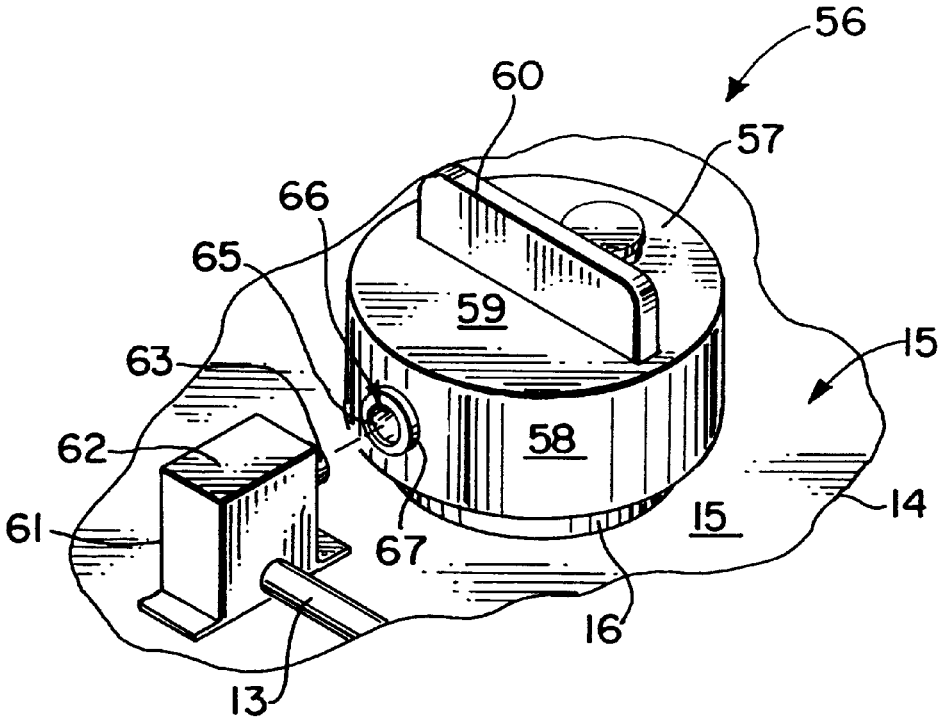
FIG. 7 is a perspective view of the third embodiment of the apparatus of the present invention.

FIGS. 6 and 7 show a third embodiment of the apparatus of the present invention designated generally by the numeral 56 in FIG. 7. Safety fuel tank and cap apparatus 56 features a filler cap 57 that is threadably engagable with annular skirt 16 as with the embodiments of FIGS. 1–5. Annular skirt 58 connects to a circular top 59 having handle 60. Switch 61 is mounted on the upper surface 15 of tank 14 as shown in FIGS. 6 and 7. The switch 61 includes a switch housing 62 that carries an electric eye 63. Such a switch 61 is commercially available. Arrow 64 in FIG. 7 indicates the communication between electric eye 63 and reflector 65 contained in opening 66 surrounded by annular rib 67. In the embodiment of FIG. 6 and 7, the electric eye is emitting a light source that reflects off reflector 65 and which is interrupted when cap 57 is removed from flange 16 so that the electrical cable 53 communicating with magneto 11 closes a circuit that prevents operation of magneto 11 to start engine E.

Figure 8:
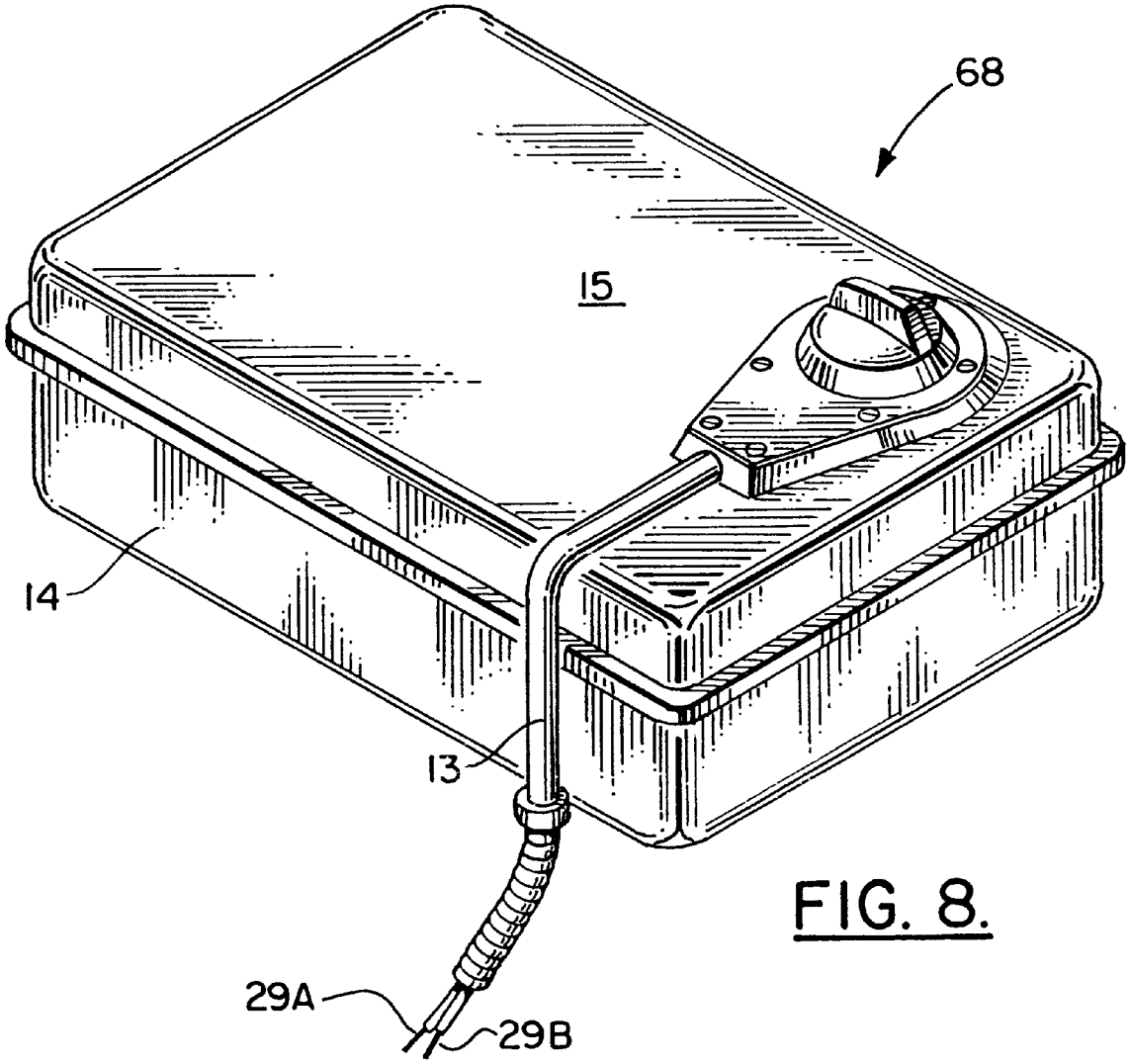
FIG. 8 is a perspective view of a fourth embodiment of the apparatus of the present invention.
Figure 9:
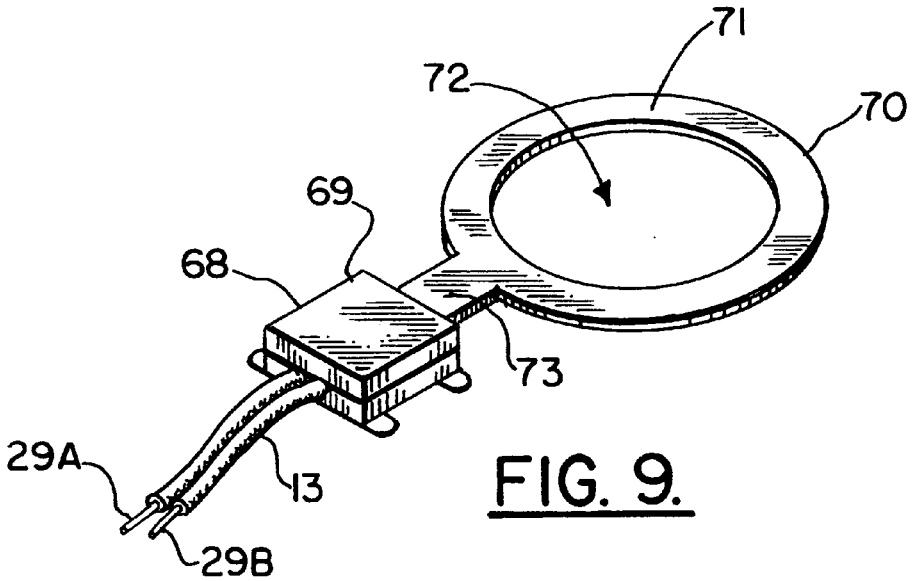
FIG. 9 is a partial perspective view of the fourth embodiment of the apparatus of the present invention.

FIGS. 8–11 show a fourth embodiment of the apparatus of the present invention designated generally by the numeral 68 in FIG. 8. Safety fuel tank and cap apparatus 68 includes a micro switch 69 having a switch arm 70 that includes a ring 71. The ring 71 surrounds opening 72 that fits over flange 16 and filler cap 74 as shown in FIGS. 8–11. The ring 71 attaches to micro switch 69 with beam 73. Such a micro switch 69 is commercially available.

Figure 10:
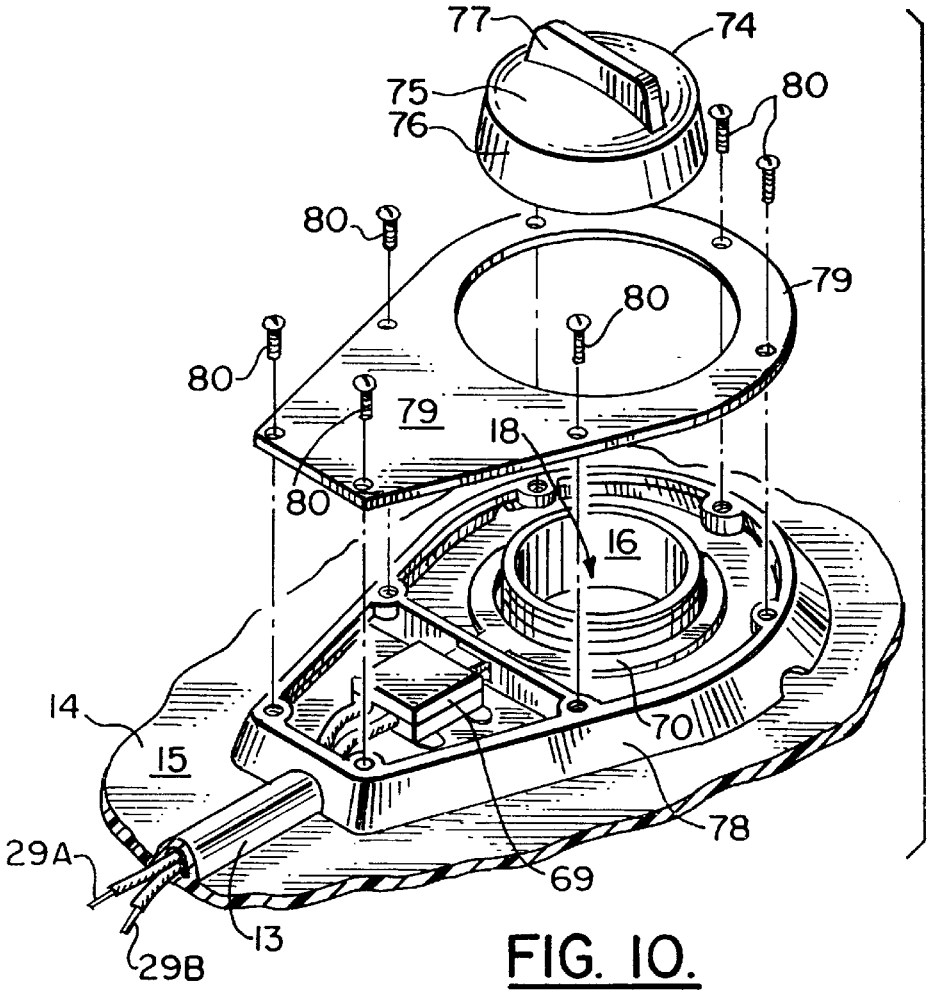
FIG. 10 is an exploded perspective view of the fourth embodiment of the apparatus of the present invention.
Figure 11:
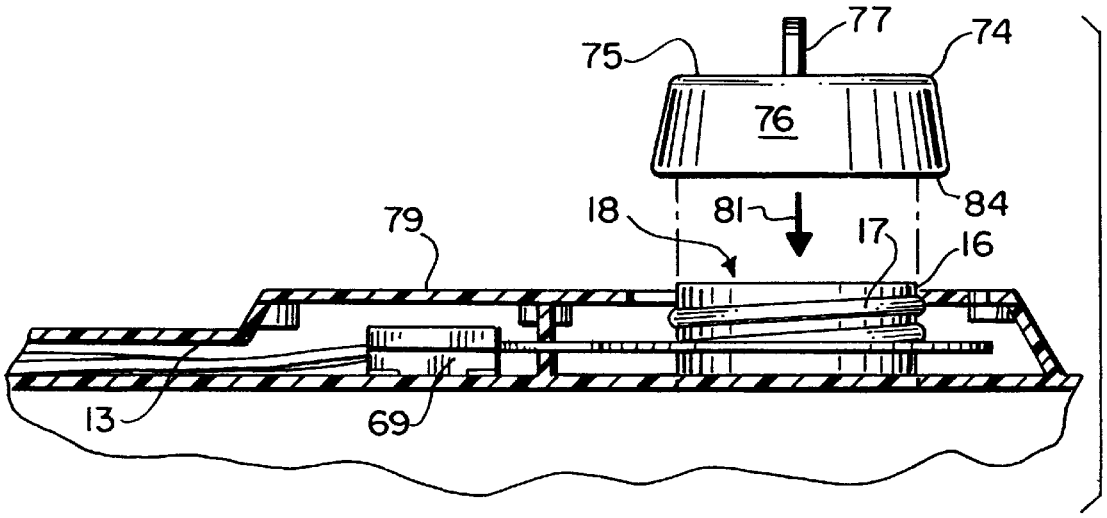
FIG. 11 is a sectional elevational, exploded view of the fourth embodiment of the apparatus of the present invention.

Filler cap 74 has a circular to 75 and a cylindrically shaped annular skirt 77. Handle 77 enables cap 74 to be able to be manipulated and turned such as when it is removed from or engaged with cylindrically shaped flange 16. A shroud 78 is provided for covering the combination of the micro switch 69 and its arm 70 as shown in FIGS. 10 and 11. The shroud 78 communicates with cover 79 that can be bolted over the shroud 78 using a plurality of bolts 80. Arrow 81 in FIG. 11 shows how the micro switch 69 is closed when the cap 74 is threaded upon flange 16 as indicated schematically by arrow 81 in FIG. 11. In such a situation, the lower annular edge 84 of cap 74 engages ring 71 of switch arm 70 forcing it downwardly and operating switch 69 to deactivating magneto 11 via electrical cable 73.

FIG. 1A shows the apparatus 10 of the present invention attached to an auxiliary fuel tank 14 having a fuel line 82. In FIG. 1B, a powered implement is shown in the form of a weed trimmer that includes a frame 85 that supports an internal combustion engine E having fuel tank 14 and filler cap 18 with magnetic switch 28.

Figure 12A:
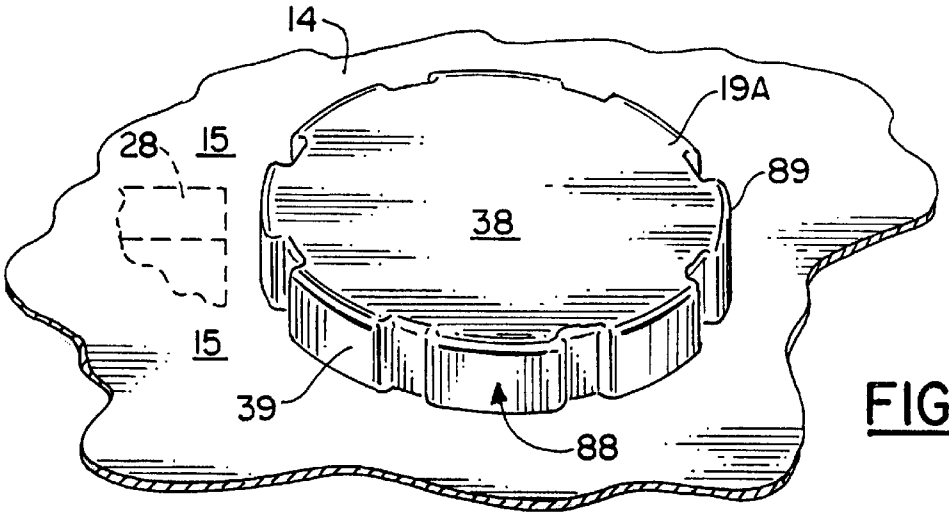
FIGS. 12A, 12B, 12C are upper perspective, bottom perspective and bottom views respectively of a filler cap construction having a bayonet type mount and that can be used with the embodiments of FIGS. 1–11.
Figure 12B:
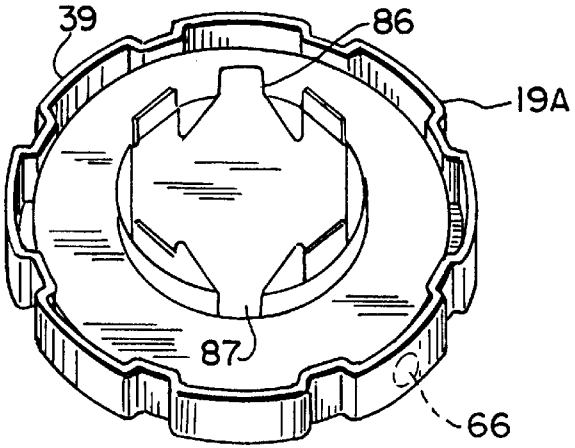
Figure 12C:
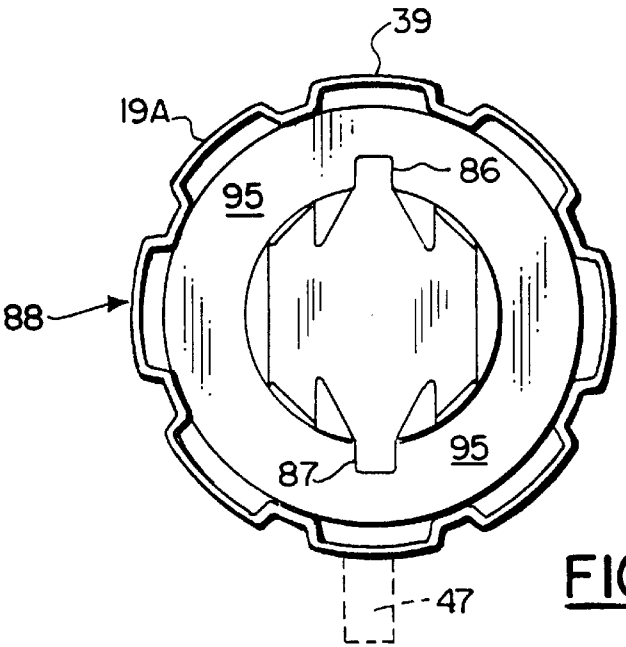

Filler cap 19A in FIGS. 12A, 12B and 12C is a Honda® type cap that can have a circular top 38, annular skirt 39 with generally cylindrically shaped outer surface 88, and annular edge 89 at the interface between top 38 and skirt 39. Cap 19 includes bayonet mount projections 86, 87 that interlock with a bayonet type flange (not shown on tank 15). Cap 19A can have gasket 95. Such an interlocking arrangement between projections 86, 87 and bayonet type flange on a fuel tank is known in the art (see for example small (e.g. 5 hp) engines sold under the marks Briggs®, Honda®, and Kawasaki®.

Figure 13A:
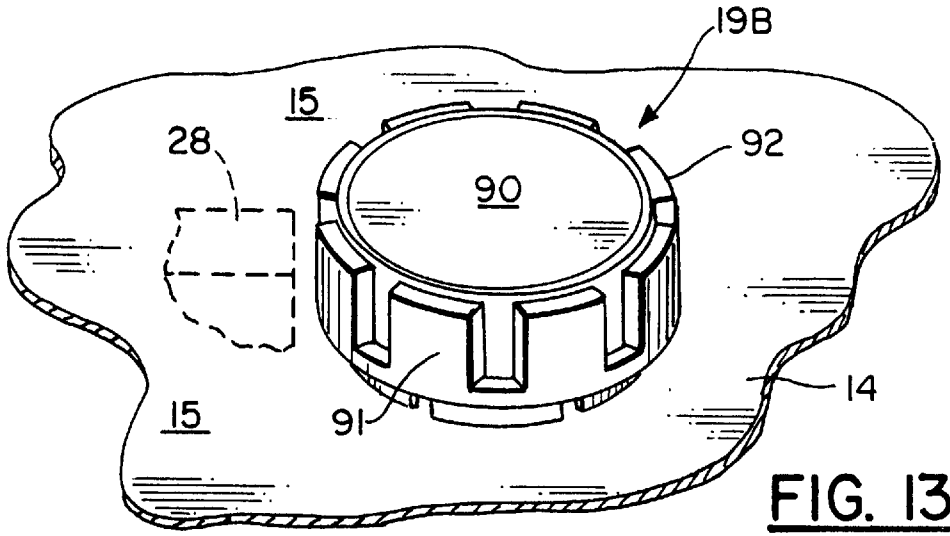
FIGS. 13A, 13B, 13C are upper perspective, bottom perspective, and bottom views respectively of another filler cap construction having a bayonet mount and that can be used with the embodiment of FIGS. 1–11.
Figure 13B:
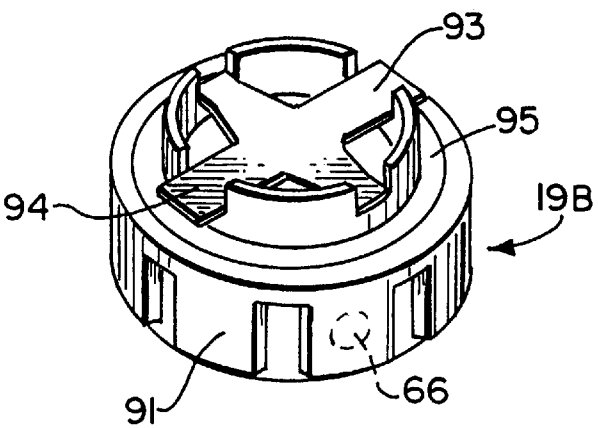
Figure 13C:
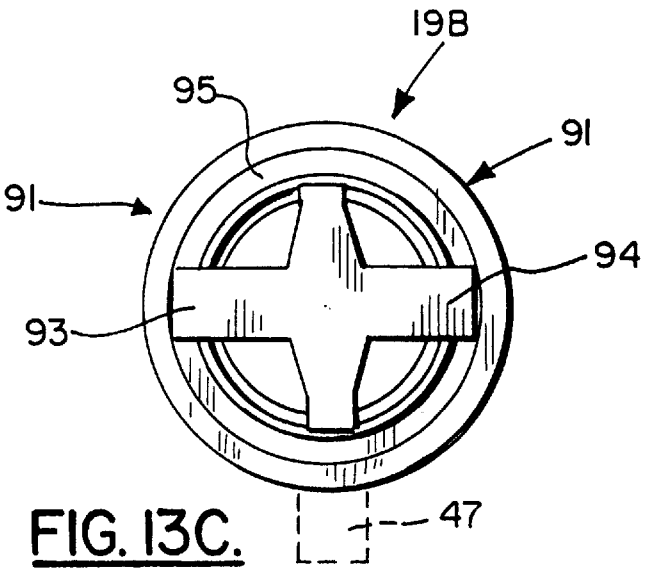

FIGS. 13A, 13B and 13C show a Briggs® type cap arrangement. Cap 19B has top 90, annular skirt 91 that joins top 90 at annular edge 92. Projections 92, 93 connect to fuel tank 15 at a filler flange having a bayonet type mount. Cap 19B has gasket 95.

In FIGS. 12A, 12B and 12C there can be seen magnetic switch 28 (FIG. 12A) used with cap 19B, the use of a photoelectric switch at opening 66 (FIG. 13B) and the use of appendage 46 (FIG. 12C) for use with button switch 48. In FIGS. 13A, 13B and 13C there can bee seen magnetic switch 28 (FIGS. 12A), opening 66 with reflector 65 as part of a photoelectric switch, and (in FIG. 12C) an appendage 46 for use with button switch 48.

FIGS. 12A, 12B, 12C 13A, 13B and 13C illustrate that a bayonet type filler cap and tank flange arrangement could be used with any of the embodiments of FIGS. 1–11.

Figure 14:
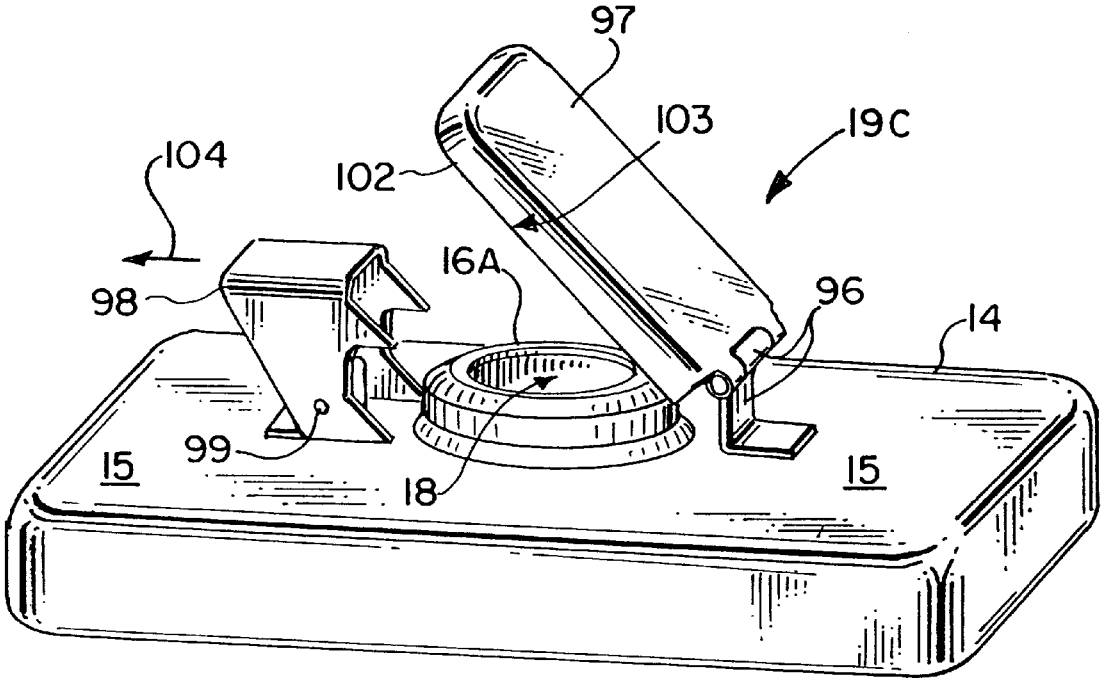
FIGS. 14–15 are perspective view of a hinged filler cap construction that can be used with the embodiment of FIGS. 1–11, showing closed and open positions respectively of the filler cap.
Figure 15:
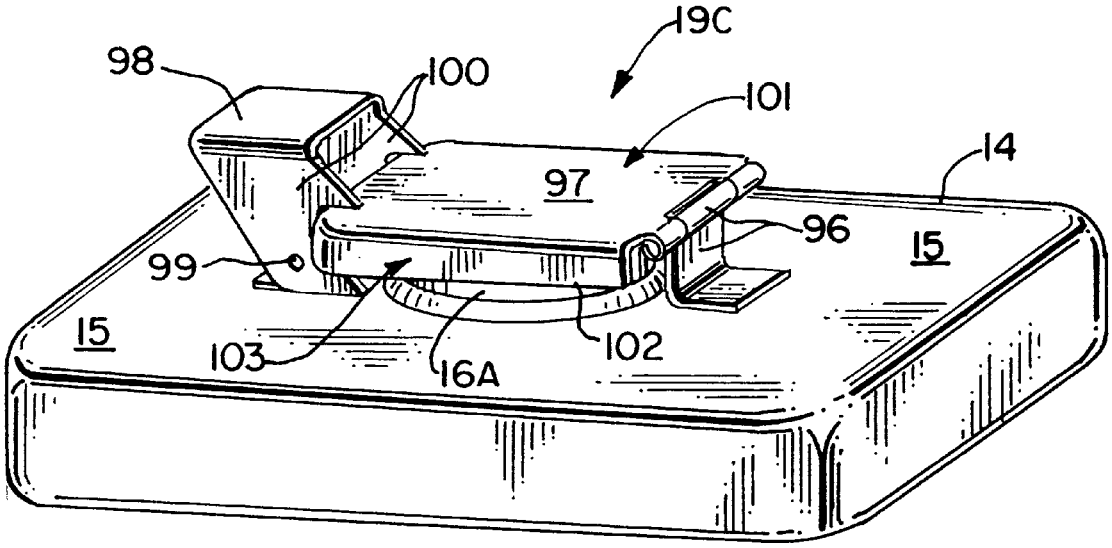

In FIGS. 14 and 15 there is shown a hinged cap arrangement that can be used with any of the embodiments of FIGS. 1–11. Hinge 96 supports spring loaded cap 97 that automatically springs open to the open position of FIG. 14 when spring loaded latch 98 is moved away from cap 97 in the direction of arrow 104. Latch member 98 is pivotally mounted to tank 15 at pivot 99. A pair of sears 100 normally hold cap 97 in the closed position of FIG. 15. When the cap 97 is closed, sears 100 are engaged and latch 98 pushed away in the direction of arrow 104 until cap 97 closes fully at which time sears 100 engage and hold cap 97. This general concept of a cap 97, hinge 96, latch 98 is known and commercially available.

Cap 97 has flat top 101, skirt 102 and skirt outer surface 103.

Following the teachings of the present invention, cap 97 could carry a magnet 25 that cooperates with switch 28 as in FIGS. 1–3. The cap 97 could carry a projection or appendage 96 as with the embodiment of FIGS. 4, 5A and 5B that cooperates with button switch 48. The cap 97 could also carry reflector 66 in opening 65 for use with photo electric switch 61 as in FIGS. 6–7.

Any of the cap constructions shown in FIGS. 12A, 12B, 12C, 13A, 13A, 13B and 13C or 14–15 can be used in combination with the micro switch arrangement of FIGS. 8–11.

Figure 16:
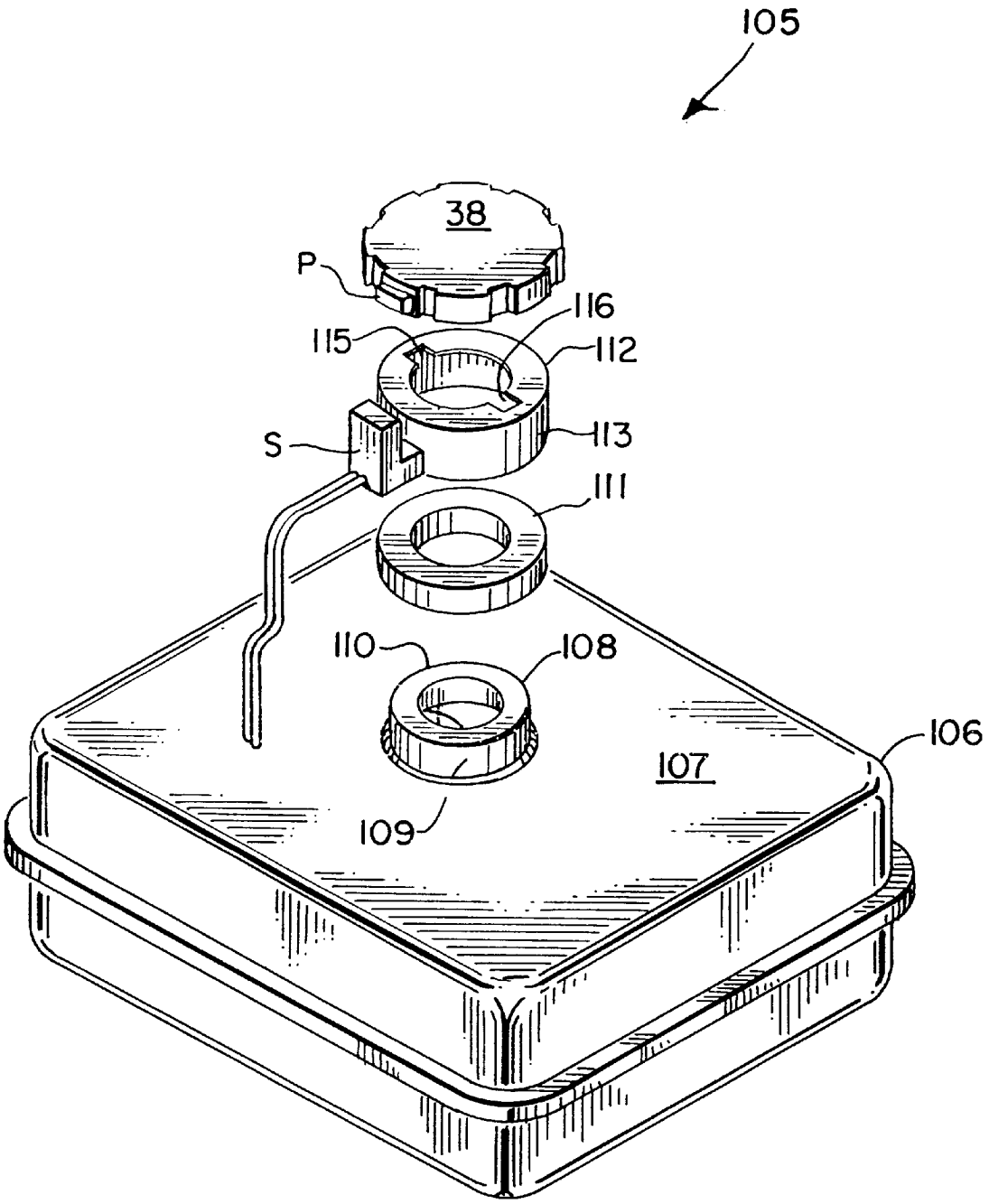
FIG. 16 is a perspective exploded view of a fifth embodiment of the apparatus of the present invention.

FIG. 16 shows an alternate embodiment of the apparatus of the present invention designated generally by the numeral 105. In FIG. 16, fuel tank 106 has an upper surface 107 with a fuel filler neck 108. In the embodiment of FIG. 16, a fuel filler neck 112 can be added to the existing fuel filler neck 108 on tank 107. As an option, an adapter 111 can be placed in between the permanent fuel filler neck 108 of tank 107 and the retrofitted fuel filler neck 112. The adapter 111 can be a cylindrically shaped or donut shaped fitment or shim that fits in between the side wall 109 of filler neck 108 and the new filler neck 112.

Filler neck 108 has an annular shoulder 110 that surrounds a central opening through which fuel can be added to the tank 107. The new filler neck 112 has a side wall 113 and an upper annular shoulder 114 that carries a pair of spaced apart slots 115, 116. These slots 115, 116 receive projections 86, 87 of the fuel filler cap 38 shown in FIGS. 12A, 12B, 12C or the filler cap 90 shown in FIGS. 13A, 13B, 13C.

Figure 17:
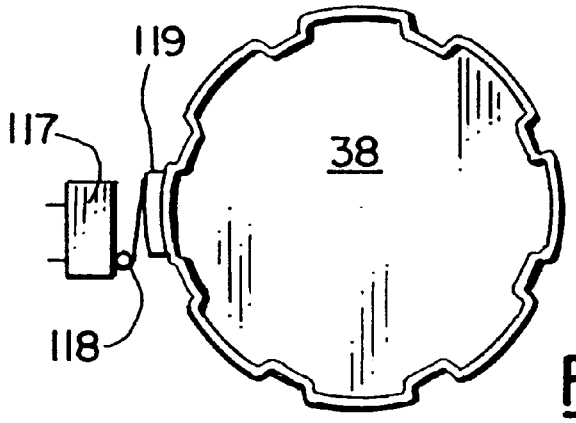
FIG. 17 is a fragmentary plan view of the fifth embodiment of the apparatus of the present invention showing a micro switch type switch arrangement.
Figure 18:
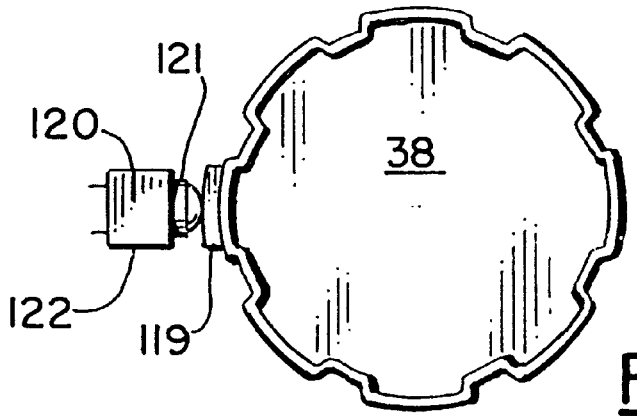
FIG. 18 is a fragmentary plan view of the fifth embodiment of the apparatus of the present invention shown with a plunger switch type switch arrangement.
Figure 19:
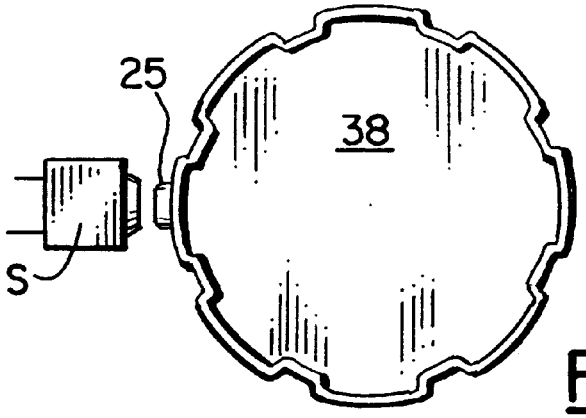
FIG. 19 is a fragmentary plan view of the fifth embodiment of the apparatus of the present invention shown with a magnetic switch proximity switch or optical switch arrangement.

The switch S in FIG. 16 schematically represents any of the selected switches that are discussed herein with respect to the preferred embodiments of FIGS. 1–15, or any of the switches shown in FIGS. 17–19. Similarly, the projection P in FIG. 16 represents the portion of an overall switch arrangement that is carried at the periphery of a cap 19, 38 or 90, for any of the embodiments of FIGS. 1–15 or 17–21B. In FIG. 17, a micro switch 117 is shown that cooperates with a projection 119 carried by cap 38 at the periphery of cap 38. The micro switch 117 has an arm 118 that is depressed in order to close the switch when the cap 38 is in a fully closed position engaging a fuel filler neck such as 112 or 16.

In FIG. 18, a plunger type switch arrangement is shown that includes a plunger type switch 120 having a housing 122 that carries a plunger 121. The plunger 121 closes relative to the housing 122 when it is depressed by projection 119. The projection 119 is carried at the periphery of cap 38 or any of the other fuel filler caps disclosed herein when the cap 38 is in its fully closed position. The switch 120 opens to shut down the engine when the projection 119 is moved away from plunger 121.

In FIG. 19, a projection 25 at the periphery of cap 38 can be a portion that cooperates with a magnetic switch, proximity switch, or optical switch, designated generally by the letter S in FIG. 19.

Figure 20A:
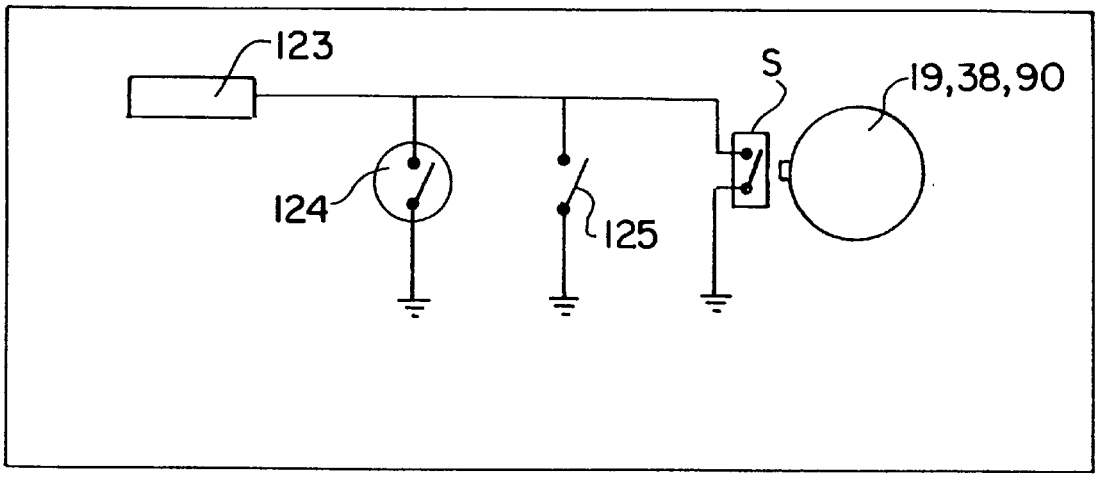
FIGS. 20A–20B are schematic wiring diagrams of the fifth embodiment of the apparatus of the present invention showing respectively in ignition system on and ignition system off wiring diagrams.
Figure 20B:
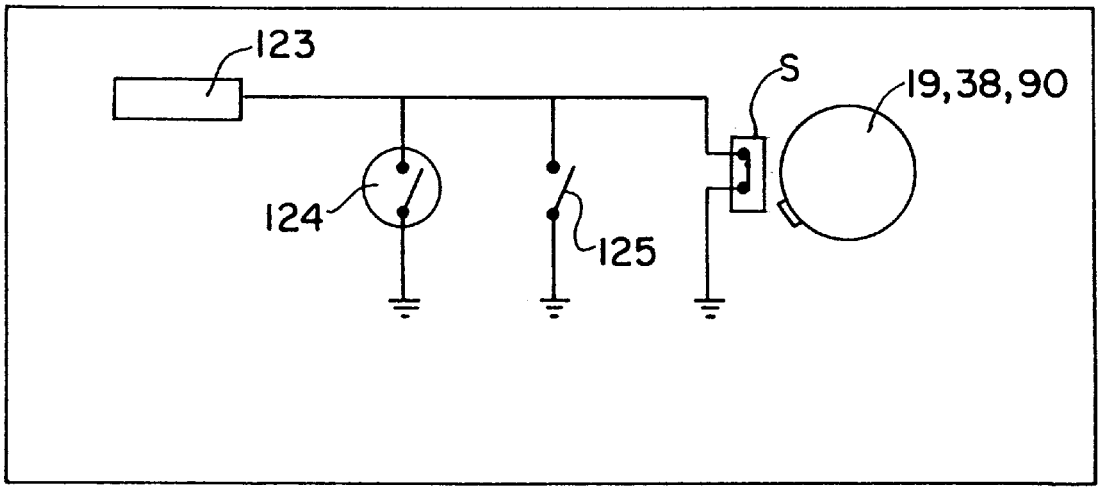

In FIGS. 20A and 20B, there is shown a wiring diagram for a ground to shut down arrangement. In FIG. 20A, an ignition system is indicated by the numeral 123 and key switch by the numeral 124. The numeral 125 indicates schematically any other ignition shut down switch. In FIG. 20A, the engine will not run if any switch is closed. Removing the fuel cap 19, 38 or 90 closes the switch S so that the engine will not run. All of the switches are wired and parallel to each other in FIG. 20A.

In FIG. 20B, the ignition system is shown in an off position. The fuel cap switch S is closed when the cap 19, 38 or 90 is not secured to the tank, and the engine will not run. The fuel cap system shown in FIG. 20B will work on any type of ignition system/shut off system including magneto type, coil type, negative and positive ground, ground to run and ground to shut down.

Figure 21A:
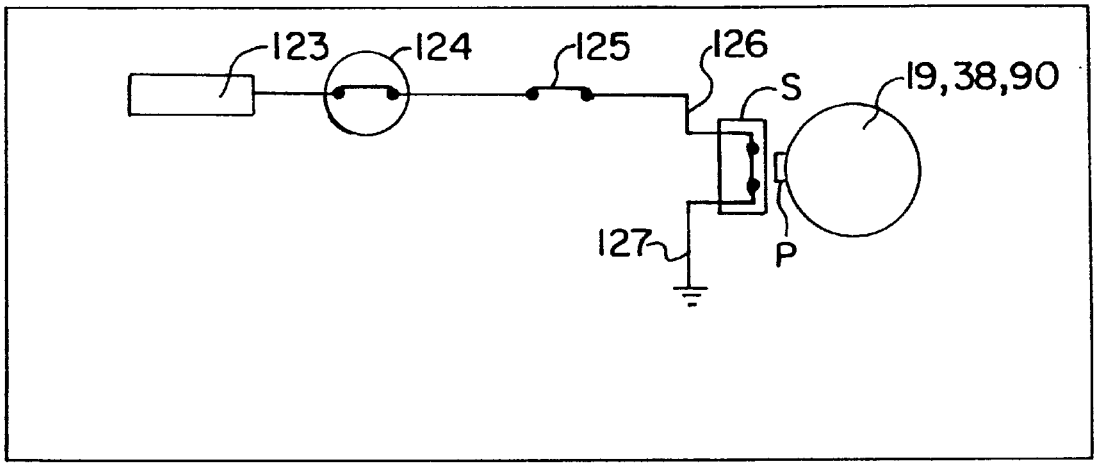
FIGS. 21A–21B are alternate circuit drawings showing an ignition system for the present invention in respective "on" and "off" positions.
Figure 21B:
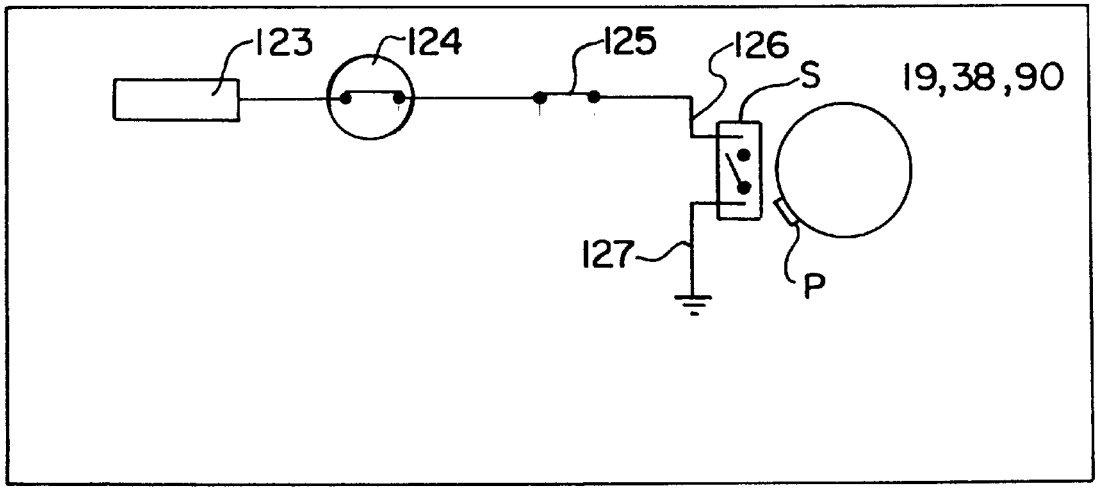

FIGS. 21A and 21B show other examples of wiring diagrams for "ignition system on" and "ignition system off" configurations respectively.

PARTS LIST

The following is a list of parts and materials suitable for use in the present invention:

| NUMBER | PART |
|---|---|
| 10 | safety fuel tank and cap apparatus |
| 11 | magnetoelectric generator |
| 12 | pull cord starter rope |
| 13 | electric cable |
| 14 | fuel tank |
| 15 | upper surface |
| 16 | cylindrically shaped flange |
| 16A | cylindrically shaped flange |
| 17 | external thread |
| 18 | opening |
| 19 | filler cap |
| 19A | filler cap |
| 19B | filler cap |
| 19C | hinged filler cap |
| 20 | annular skirt |
| 20A | inner annular surface |
| 20B | outer annular surface |
| 21 | top |
| 22 | handle |
| 23 | internal thread |
| 24 | vent |
| 25 | magnet |

-continued

| NUMBER | PART |
|---|---|
| 26 | outer end |
| 27 | inner end |
| 28 | magnetic switch |
| 29A | lead |
| 29B | lead |
| 30 | ground |
| 31 | arrow |
| 32 | arrow |
| 33 | spring |
| 34 | contact plate |
| 35 | contact point |
| 36 | contact point |
| 37 | annular edge |
| 38 | circular top |
| 39 | annular skirt |
| 40 | safety fuel tank and cap apparatus |
| 41 | cap |
| 42 | handle |
| 43 | vent |
| 44 | annular skirt |
| 45 | top |
| 46 | appendage |
| 47 | undersurface |
| 48 | button switch |
| 49 | contact |
| 50 | contact |
| 51 | spring |
| 52 | contact plate |
| 53 | switch bottom |
| 54 | arrow |
| 55 | arrow |
| 56 | safety fuel tank and cap apparatus |
| 57 | filler cap |
| 58 | annular skirt |
| 59 | top |
| 60 | handle |
| 61 | switch |
| 62 | switch housing |
| 63 | electric eye |
| 64 | arrow |
| 65 | reflector |
| 66 | opening |
| 67 | annular rib |
| 68 | safety fuel tank and cap apparatus |
| 69 | micro switch |
| 70 | switch arm |
| 71 | ring |
| 72 | opening |
| 73 | beam |
| 74 | filler cap |
| 75 | top |
| 76 | annular skirt |
| 77 | handle |
| 78 | shroud |
| 79 | cover |
| 80 | bolt |
| 81 | arrow |
| 82 | fuel line |
| 83 | weed trimmer |
| 84 | annular surface |
| 85 | frame |
| 86 | laterally extending projection |
| 87 | laterally extending projection |
| 88 | outer annular surface |
| 89 | annular edge |
| 90 | circular top |
| 91 | outer annular surface |
| 92 | annular edge |
| 93 | laterally extending projection |
| 94 | laterally extending projection |
| 95 | gasket seal |
| 96 | hinge |
| 97 | spring loaded cap member |
| 98 | spring loaded latch |
| 99 | pivot |
| 100 | sear |
| 101 | flat top |

-continued

| NUMBER | PART |
|---|---|
| 102 | skirt |
| 103 | outer surface |
| 104 | arrow |
| 105 | safety fuel tank and cap apparatus |
| 106 | fuel tank |
| 107 | upper surface |
| 108 | fuel filler neck |
| 109 | side wall |
| 110 | annular shoulder |
| 111 | adaptor |
| 112 | filler neck |
| 113 | side wall |
| 114 | annular shoulder |
| 115 | slot |
| 116 | slot |
| 117 | micro switch |
| 118 | arm |
| 119 | projection |
| 120 | plunger type switch |
| 121 | plunger |
| 122 | housing |
| 123 | ignition system |
| 124 | key switch |
| 125 | switch |
| 126 | lead |
| 127 | ground |
| P | projection |
| S | switch |
| E | engine |

All measurements disclosed herein are at standard temperature and pressure, at sea level on Earth, unless indicated otherwise.

The foregoing embodiments are presented by way of example only; the scope of the present invention is to be limited only by the following claims.

What is claimed is:

1. A safety fuel tank and filler cap apparatus for supplying fuel to an internal combustion engine that is started with a magnetoelectric generator, comprising;

a) an exposed fuel tank having a tank wall with an exterior surface, a tank interior for holding fuel, and a fill opening;

b) an annular fuel filer flange positioned on the exterior surface of the tank wall, said annular flange having a central axis;

c) a filler cap that removably connects to the fuel filler flange to form a closure of the tank at the fill opening when the cap center generally aligns with the flange central axis, said filler cap and adjoining fuel tank outer surface being configured to enable a user to grip and manipulate said fuel filler cap during removal from said annular fuel filler flange; and d) a switch that does not include any switch portions that are contained within the tank interior, interfaced between the fuel tank and filler cap, that disables operation of the magnetoelectric generator when the filler cap is removed from the fuel filler flange.

2. The apparatus of claim 1 wherein the switch is a magnetic switch.

3. The apparatus of claim 1 wherein the switch is a photoelectric switch.

4. The apparatus of claim 1 wherein the switch is a mechanical switch that moves between operating and disabled positions, the switch including a member that shift positions when the fuel filler cap is separated from the fuel filler flange.

5. The apparatus of claim 2 wherein the switch includes a magnetic switch mounted on the fuel tank and a magnet mounted on the filler cap.

6. A safety fuel tank and filler cap apparatus for supplying fuel to an internal combustion engine that includes a magnoelectric generator for starting the engine, comprising:

an exposed fuel tank having a fill opening and an annular fuel filler flange at the fill opening surrounded by an adjoining fuel tank outer surface, said annular fuel filler flange having a central axis;

b) a filler cap that removably attaches to the fuel filler flange to form a closure of the tank at the fill opening when the cap center generally aligns with the flange central axis said filler cap and adjoining fuel tank outer surface being configured to enable a user to grip and manipulate said fuel filler cap; and c) a switch interfaced between the fuel tank and filler cap that disables the magnetoelectric generator when the filler cap is removed from the fuel filler flange; and d) wherein the switch includes a switch member mounted on the filler cap that does not interfere with a sealing of the fuel filler flange with the filler cap.

7. The apparatus of claim 6 wherein the fuel filler flange has a threaded portion, and the filler cap has a top and an annular skirt with threads thereon that engage the threaded portion of the flange, wherein the switch member is mounted on the annular skirt in between the threads and the top.

8. The apparatus of claim 6 wherein the filler cap has a top, an annular skirt with internal threads, and an unthreaded outer surface, wherein the switch member is mounted on the annular skirt.

9. The apparatus of claim 6 wherein the filler cap has a top, an annular skirt with internal threads, and an unthreaded outer surface, wherein the switch member is mounted on the top.

10. A safety fuel tank and filler cap apparatus for supplying fuel to and internal combustion engine that is started with a magnetoelectric generator, comprising:

a) an exposed fuel tank having a tank wall with an exterior surface a tank interior for holding fuel, and a fill opening;

b) an annular fuel filler flange positioned on the exterior surface of the tank wall, said flange including a flange wall extending a short distance from the filler opening in said fuel tank wall, said annular flange having a central axis;

c) a filler cap that removably connects to the fuel filler flange to form a closure of the tank at the fill opening, said filler cap having a center, wherein the adjoining fuel tank outer surface is configured to enable a user to grip and manipulate said fuel filler cap;

d) a switch interfaced between the fuel tank and filler cap that disables the magnetoelectric generator when the filler cap is removed from the fuel filler flange by rotating the cap about its center and about the annular flange central axis, said switch including switch portions mounted respectively on the exterior surface of the fuel tank, and on the fuel filler cap, both switch portions being positioned next to the assembly of filler cap and fuel filler flange when the cap forms a closure of the tank.

11. The apparatus of claim 10 wherein the switch is a magnetic switch.

12. The apparatus of claim 10 wherein the switch is a photoelectric switch.

13. The apparatus of claim 10 wherein the switch is a mechanical switch that moves between operating and disabled positions the switch including a member that shift positions when the fuel filler can is separated from the fuel filler flange.

14. The apparatus of claim 10 wherein the switch includes a magnetic switch mounted on the fuel tank and a magnet mounted on the filler cap.

15. The apparatus of claim 10 wherein the switch includes a switch member mounted on the filler cap that does not interfere with a scaling of the fuel filler flange with the filler cap.

16. The apparatus of claim 10 wherein the fuel filler flange has a threaded portion and the filler car has a top, and an annular skirt with threads thereon that engage the threaded portion of the flange, and wherein the switch member is mounted on the annular skirt in between the threads and the top.

17. The apparatus of claim 10 wherein the filler cap has a top, an annular skirt with internal threads, and an unthreaded outer surface and wherein the switch member is mounted on the annular skirt.

18. The apparatus of claim 10 wherein the filler cap has a top, an annular skirt with internal threads, and an unthreaded outer surface and wherein the switch member is mounted on the top.

19. A powered implement, comprising:

a) a frame;

b) an internal combustion engine mounted on the frame that includes a magnetoelectric generator for starting the engine, c) an exposed fuel tank having a fuel tank wall, a tank interior, a fill opening, a fuel filler flange surrounded by an adjoining fuel tank outer surface, said flange extending a short distance from the filler opening in said fuel tank wall;

d) a filler cap that removably connects to the fuel filler flange to form a closure of the tank at the fill opening, said filler cap and adjoining fuel tank outer surface being configured to enable a user to grip and manipulate said fuel filler cap;

e) a switch interfaced between the fuel tank and filler cap that disables the magnetoelectric generator when the filler cap is removed from the fuel filler flange, said switch including switch portions mounted respectively on the fuel tank and on the fuel filler cap; and f) wherein the switch does not include any portions that extend through an opening in the tank wall.

20. The apparatus of claim 19 wherein the switch is a magnetic switch.

21. The apparatus of claim 19 wherein the switch is a photoelectric switch.

22. The apparatus of claim 19 wherein the switch is a mechanical switch that moves between operating and disabled positions, the switch including a member that shift positions when the fuel filler cap is separated from the fuel filler flange.

23. The apparatus of claim 20 wherein the switch includes a magnetic switch mounted on the fuel tank and a magnet mounted on the filler cap.

24. A powered implement, comprising:

a) a frame;

b) an internal combustion engine mounted on the frame that includes a magnetoelectric generator for starting the engine;

c) an exposed fuel tank having a fill opening a fuel filler flange surrounded by an adjoining fuel tank outer surface, said flange extending a short distance from the filler opening in said fuel tank wall:

d) a filler can that fits the fuel filler flange to form a closure of the tank at the fill opening, said filler cap and adjoining fuel tank outer surface being configure to enable a user to grip and turn said fuel filler can:

e) a switch interfaced between the fuel tank and filler can that disables the magnetoelectric generator when the filler cap is removed from the fuel filler flange, said switch including switch portions mounted respectively on the fuel tank and on the fuel filler cap; and f) wherein the switch includes a switch member mounted on the filler cap that does not interfere with a sealing of the fuel filler flange with the filler cap.

25. The apparatus of claim 24 wherein the filler cap has a top, and an annular skirt with internal threads, and wherein the switch member is mounted on the annular skirt in between the threads and the top.

26. The apparatus of claim 24 wherein the filler cap has a top, an annular skirt with internal threads, and an unthreaded outer surface, wherein the switch member is mounted on the annular skirt.

27. The apparatus of claim 24 wherein the filler cap has a top, an annular skirt with internal threads, and an unthreaded outer surface, wherein the switch member is mounted on the top.

28. A powered implement, comprising:

a) a frame;

b) an internal combustion engine mounted on the frame, said engine including a magnetoelectric generator for starting the engine;

c) the frame and engine supporting an exposed fuel tank having a tank wall surrounding a tank interior and a fill opening through said tank wall;

d) a fuel filler flange on said tank wall surrounded by an adjoining fuel tank outer surface, said flange extending a short distance from the fill opening in said fuel tank wall;

e) a filler cap that removably attaches to the fuel filler flange to form a closure of the tank at the fill opening, said filler cap and adjoining fuel tank outer surface being configured to enable a user to grip and manipulate said fuel filler cap;

f) a switch interfaced between the fuel tank and filler cap that disables the magnetoelectric generator when the filler cap is removed from the fuel filler flange, said switch including switch portions mounted respectively on the fuel tank and on the fuel filler cap; and g) wherein the switch includes a first portion mounted on the fuel tank wall eternally of the tank interior and a second portion mounted on the filler can, externally of the tank interior.

29. The apparatus of claim 28 wherein the switch is a magnetic switch.

30. The apparatus of claim 28 wherein the switch is a photoelectric switch.

31. The apparatus of claim 28 wherein the switch is a mechanical switch that moves between operating and disabled positions, the switch including a member that shift positions when the fuel filler cap is separated from the fuel filler flange.

32. The apparatus of claim 28 wherein the switch includes a magnetic switch mounted on the fuel tank and a magnet mounted on the filler cap.

33. The apparatus of claim 28 wherein the switch includes a switch member mounted on the filler cap that does not interfere with a scaling of the fuel filler flange with the filler cap.

34. The apparatus of claim 28 wherein the fuel filler flange has a threaded portion and the filler cap has a top, and an annular skirt with threads thereon that engage the threaded portion of the flange, and wherein the switch member is mounted on the annular skirt in between the threads and the top.

35. The apparatus of claim 28 wherein the filler cap has a top, an annular skirt with internal threads, and an unthreaded outer surface and wherein the switch member is mounted on the annular skirt.

36. The apparatus of claim 28 wherein the filler cap has a top, an annular skirt with internal threads, and an unthreaded outer surface and wherein the switch member is mounted on the top.

37. The apparatus of claim 19 wherein the cap is pivotally attached to the tank and further comprising a releasable latch that holds the can closed.

38. The apparatus of claim 28 wherein the cap is pivotally attached to the tank and further comprising a releasable latch that holds the cap closed.

* * * * *